United States Patent [19]

Plagge et al.

[11] 4,326,146

[45] Apr. 20, 1982

[54] BASE AND TERMINAL-PIN ASSEMBLY FOR ELECTRIC LAMPS AND SIMILAR DEVICES

[75] Inventors: Vernon L. Plagge, East Orange; Clair M. Rively, Middletown Township, Monmouth County, both of N.J.

[73] Assignee: Westinghouse Electric Corp., Pittsburgh, Pa.

[21] Appl. No.: 136,649

[22] Filed: Apr. 2, 1980

[51] Int. Cl.[3] ..... H01J 5/48; H01J 5/50

[52] U.S. Cl. ..... 313/318; 313/217; 313/331; 339/145 D; 339/54; 339/221 L; 339/273 F

[58] Field of Search ..... 313/318, 331, 217; 339/53, 54, 221 R, 221 L, 267, 269, 271, 273 F, 273 S, 145 R, 145 D; 174/197, 198, 199

[56] References Cited

U.S. PATENT DOCUMENTS

| | | | |
|---|---|---|---|
| 2,733,421 | 1/1956 | Grovemiller | 339/221 L |
| 2,771,589 | 11/1956 | Thomas | 339/144 |
| 2,913,697 | 11/1959 | Caplis et al. | 339/146 |
| 3,534,216 | 10/1970 | Gilbert, Jr. et al. | 313/331 X |
| 3,546,523 | 12/1970 | Gilbert, Jr. | 313/331 |
| 3,805,215 | 4/1974 | Davis, Jr. | 339/221 L |
| 4,057,315 | 11/1977 | Miller et al. | 339/221 R |
| 4,102,558 | 7/1978 | Krachman | 339/145 D |

FOREIGN PATENT DOCUMENTS

| | | | |
|---|---|---|---|
| 2523448 | 2/1976 | Fed. Rep. of Germany | 339/221 R |
| 1060271 | 3/1967 | United Kingdom | 339/221 R |

*Primary Examiner*—Saxfield Chatmon, Jr.
*Attorney, Agent, or Firm*—D. S. Buleza

[57] ABSTRACT

The lead-in wires of a fluorescent lamp (or similar device) are electrically connected to the base pins by mechanical means instead of welding or soldering the members to each other in the conventional manner during the lamp-basing operation. This is achieved by forming the pins from solid metal or heat-tempered "stiff" sheet metal, placing the ends of the precut lead wires in a pair of apertures provided in the plastic insulator portion of the base, and then force-fitting the ends of the rigid metal pins into the apertures so that they are firmly anchored in the insulator portion—thus clamping the pins in positive engagement with the captured ends of the lead wires and concurrently completing the base assembly. The length of the exposed portions of the metal pins and the spacing therebetween are controlled to provide pin-terminals that conform with established standards but eliminate the expensive and inefficient soldering or welding operations required to connect the lead wires to the hollow pins of conventional type bases that are preassembled and thus have such hollow pins previously staked or fastened to the base structure.

10 Claims, 6 Drawing Figures

BASE AND TERMINAL-PIN ASSEMBLY FOR ELECTRIC LAMPS AND SIMILAR DEVICES

BACKGROUND OF THE INVENTION

This invention generally relates to electric lamps and has particular reference to an improved base and terminal-pin assembly for fluorescent lamps and similar electrical devices.

In accordance with current manufacturing practice, conventional type fluorescent lamps are provided with base assemblies having hollow brass pins that are staked to the insulator portion of the base assembly. During the lamp-basing operation, the lead wires that extend from the lamp envelope are threaded through apertures in the tips of the hollow pins, trimmed and then electrically connected to the pins by soldering or welding after the base has been placed on the sealed end of the envelope. Due to the small size of the base pins and the random location of the lead wires relative to the sealed ends of the lamp envelopes, it was very difficult to align the lead wires with the pins and then insert them through the pin apertures during the basing operation, particularly at the high-production speeds used in the industry. The lead-wire soldering or welding operations also create manufacturing problems since they require equipment that is very costly to maintain and, unless properly adjusted and frequently monitored, produces poor welds or soldered connections with resultant losses in both material and labor. It would accordingly be very desirable to provide a base assembly and a terminal-pin structure that would eliminate all of the foregoing manufacturing and quality problems.

Various schemes for mechanically fastening lamp lead wires to a base component have been employed in the prior art. For example, in U.S. Pat. No. 2,771,589 issued Nov. 20, 1956 to Thomas, the lead wires of a fluorescent lamp are mechanically anchored in "pockets" within a plastic base member by force-fitted metal eyelets to provide a recessed-contact type base assembly. In U.S. Pat. No. 3,546,523 to Gilbert, Jr., the lead wires of a circular-shaped fluorescent lamp are connected to the base pins by forcing the ends of the lead wires into the slotted inner ends of the base pins that are embedded in the holder portion of a "snap type" base assembly. In U.S. Pat. No. 2,913,697 to Caplis et al. (FIGS. 1–4 embodiment), the lead wires of a "three-light" type incandescent lamp are fastened to the base insulator by nails of easily deformed material (such as lead) that are forcibly driven into the plastic insulator and effect an electrical juncture with the clamped ends of the lead wires.

SUMMARY OF THE INVENTION

In accordance with the present invention, the foregoing manufacturing and quality-control problems associated with the use of fluorescent lamp bases that have hollow metal pins which must be threaded over and then soldered or welded to the lamp lead wires are avoided by employing a novel base and pin construction that permits the lead wires to be mechanically anchored to the base assembly and concurrently electrically connected to the base pins. In accordance with a preferred embodiment, the base member comprises a cap-shaped component of thermosetting type plastic that is secured to the sealed end of the fluorescent lamp envelope and has a pair of apertures which accommodate the precut ends of the lead wires. The base pins are fabricated from solid metal (or in the form of stiff metal tubes) with end portions that are inserted into the apertures in the base component after the latter has been placed on the sealed end of the envelope. The end portions of the metal pins are so dimensioned that they effect a tight frictional force-fit with the plastic base and are thus securely clamped in positive electrical contact with the "captured" ends of the lead wires that are located in the apertures. The force-fitted end segments of the base pins are preferably provided with a roughened surface so that they "bite" into the plastic base and firmly lock the pins and lead wires in place. The diameter and exposed lengths of the force-fitted metal pins are also such that the resulting terminal-pin structure conforms with established standards for "pin-type" fluorescent lamp bases.

BRIEF DESCRIPTION OF THE DRAWING

A better understanding of the invention will be obtained from the exemplary embodiments shown in the accompanying drawing, wherein.

DESCRIPTION OF THE PREFERRED EMBODIMENTS

While the present invention can be employed in the manufacture of various types of electric lamps and similar devices which require pin-type connectors and create the aforementioned production and quality-control problems, it is particularly adapted for use in conjunction with the manufacture of fluorescent lamps and it has accordingly been so illustrated and will be so described.

Figure 1:
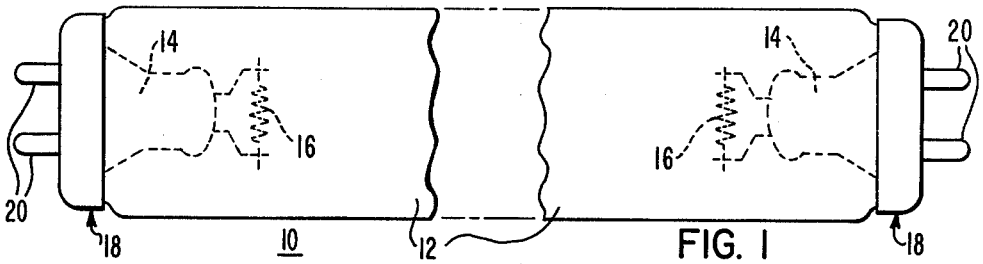
FIG. 1 is a side-elevational view of a fluorescent lamp which embodies the invention, a portion of the lamp envelope being removed for convenience of illustration.

A fluorescent lamp 10 which has the novel base and terminal-pin construction of the present invention is illustrated in FIG. 1. As will be noted, the lamp 10 consists of the usual tubular glass envelope 12 that is provided with an inner coating of phosphor and is hermetically sealed at each end by a glass stem 14. In accordance with standard lamp-making practice, the envelope 12 is filled with a suitable starting gas (such as several Torr of neon) and is dosed with mercury to provide an ionizable medium within the sealed envelope which permits an electric discharge to pass between a pair of thermionic electrodes 16 mounted on the respective stems 14. Each of the sealed ends of the lamp 10 are provided with a base assembly 18 which includes a pair of axially-extending metal pins 20 which serve as terminals that are adapted to permit the lamp 10 to be inserted into the socket components of a lighting fixture and be operated from a suitable power supply.

Figure 2:
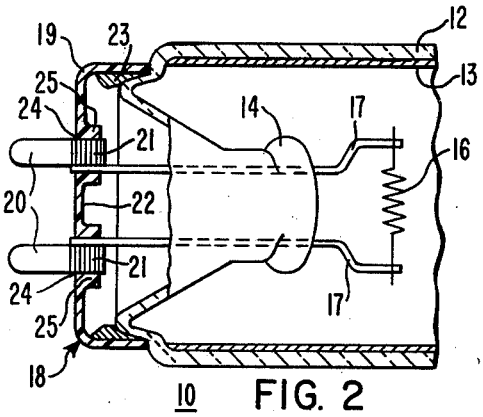
FIG. 2 is an enlarged sectional view of one end of the lamp shown in FIG. 1 illustrating the structural features of the improved base and pin terminals.

As shown more particularly in the enlarged sectional view of one end of the lamp 10 illustrated in FIG. 2, the phosphor coating 13 extends to the seal area (formed when the glass stem 14 is fused to the end of the tubular envelope 12) and the electrodes 16 are fastened to a pair of conductors such as lead-in wires 17 that extend through the stem into the base assembly 18.

In accordance with the present invention, each of the base assemblies 18 comprise a cap-shaped member or shell 19 of suitable insulating material such as a thermosetting plastic (a wood-filled phenolformaldehyde plastic resin for example) that has an end wall 22 which supports the terminal-pins 20. The base shell 19 is secured to the sealed end of the envelope 12 by a ring of suitable cement 23 or other means and the pins 20 are then secured to the shell. Pursuant to the invention, this is achieved by providing the end wall 22 of the plastic shell portion 19 of the base 18 with a pair of spaced apertures 24 that are dimensioned to effect a tight frictional force-fit with the end segments 21 of the pins 20. The outer ends of the lead wires 17 are substantially straight and cut to such a length that they extend into the apertures 24 and terminate substantially flush with the outer surface of the end wall 22 of the base shell 19 when the shell is placed on the envelope. The ends of the lead wires 17 are thus firmly clamped in positive electrical contact with the ends 21 of the metal pins 20 and extend in the same general direction as the pins when the pins are forcibly inserted into the apertures 24. In order to prevent the end wall 22 of the plastic base 19 from cracking during the pin-inserting operation, the regions around the apertures 24 are reinforced by bosses 25 which increase the wall thickness at these locations by an amount sufficient to enable the end wall to withstand the stresses produced by the force-fitting of the pins 20.

Figure 3A:
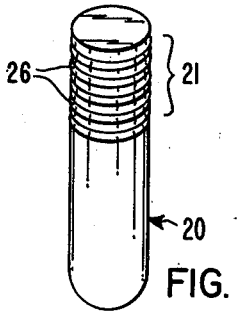
FIG. 3A is an enlarged pictorial view of one of the base pins employed in the fluorescent lamp shown in FIGS. 1 and 2.

As shown more particularly in FIG. 3A, the terminal pins 20 in this embodiment are fabricated from solid metal such as brass or aluminum. If aluminum is employed, it can be plated with a suitable metal (such as copper or the like) to provide protection against corrosion, if necessary. The pins 20 can also be formed from wire stock which is cut into the required length by a suitable automated unit that will also perform the pin-insertion operation during lamp manufacture.

In order to strengthen the mechanical interlock between the force-fitted pins 20 and the plastic base shell 19, the surfaces of the inserted ends 21 of the pins are provided with a plurality of circumferential grooves which provide sharp teeth or ridges 26 that "bite" into the plastic shell and thus increase the penetration and frictional gripping action between the pins and plastic material.

The depth of pin insertion and the diameter of the pins 20 are such that the resulting pair of elongated terminals conform with the standards established in the industry for "bi-pin" type fluorescent lamps.

Figure 3B:
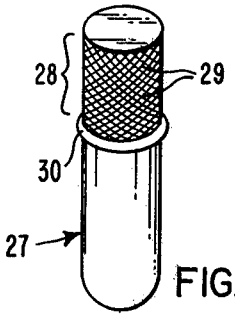
FIGS. 3B and 3C are similar views of alternative forms of base pins in accordance with the invention.

An alternative form of pin 27 is shown in FIG. 3B. It is also composed of solid metal but its force-fitting end segment 28 is provided with a knurled surface 29 which effects the "cutting action" and enhanced gripping of the plastic end wall 22 of the base shell 19. In order to ensure that the exposed portion of the pin 27 is of the proper length, a circumferential ridge or boss 30 may also be formed on the pin along the terminus of the knurled end portion 28. The boss 30 will thus contact the outer face of the base end wall 22 during pin insertion and serve as automatic stop means. One or more laterally-extending nodes or ribs can be used instead of the boss 30 for the same purpose.

Figure 3C:
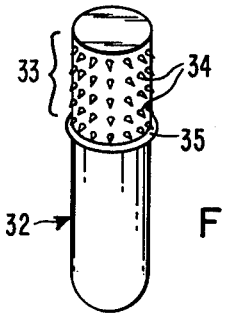

Another type of pin 32 is shown in FIG. 3C. According to this embodiment, the force-fitting end segment 33 is provided with a series of sharp prongs or burrs 34 which provide the desired "rough" surface. The end segment 33 is also delineated by a circumferential shoulder or boss 35 that serves as a stop means during pin insertion.

While the base pins 20, 27 and 32 as shown are fabricated from solid metal, they can also be fabricated from metal tubing which has thick walls so that the pins are strong and rigid enough to withstand the compressive effects of the pin-insertion operation without bending and possibly working loose when the finished lamp 10 is placed into its socket. The terminal ends of such hollow tubular pins will, of course, be closed and provided with a smooth rounded surface. The required pin-rigidity or "stiffness" can also be achieved by making the pins from thin sheet metal and tempering the hollow tubular pins sufficiently, either during pin-fabrication or by a separate heat-treating operation.

Figure 4:
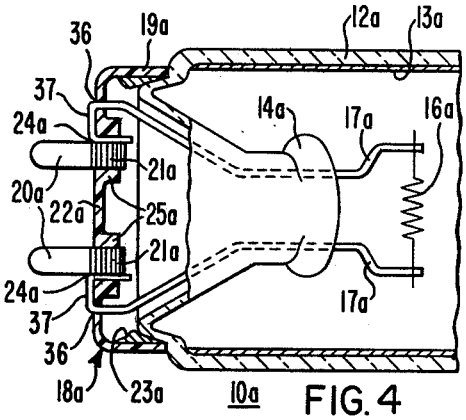
FIG. 4 is an enlarged sectional view of one end of another fluorescent lamp embodiment with a modified base and pin assembly.

A slightly modified base and terminal-pin construction is shown in FIG. 4. The base assembly **18*a* comprises a plastic cap-shaped shell component 19*a* that is secured by a ring of cement 23*a* to the sealed end of the envelope 12*a* of the fluorescent lamp 10*a*, as in the previous embodiment. However, the end wall 22*a* of the plastic shell 19*a* is provided with a second pair of apertures 36 that are located in line with but outwardly from the apertures 24*a* which receive the metal pins 20*a*. The outer ends of the lead wires 17*a* are inserted through apertures 36, bent around the outer face of the base end wall 22*a* and the ends of the lead wires are then bent inwardly into the apertures 24*a* where they are firmly clamped in positive engagement with the roughened end segments 21*a* of the inserted pins 20*a*. Portions 37 of the lead wires 17*a* thus extend along the outer face of the base shell 19*a* in accordance with this embodiment, but the straight end segments of the lead wires are entirely located within the confines of the base structure 18*a* and extend in the same general direction as the pins 20*a***.

If desired or more practical from a manufacturing standpoint, the second set of apertures 36 can be located inwardly from the pin apertures **24*a* immediately adjacent the reinforcing bosses 25*a* so that the lead wires 17*a* do not have to flare outwardly but can be relatively straight and extend directly into the apertures 36**.

While the base shells of the illustrated base assemblies 18 and **18*a*** are of "all-plastic" construction, the invention is not limited to this specific type of base but can also be employed with "composite type" base assemblies that have a metal shell component with a plastic insulator component that is secured to metal shell and forms the end wall of the base. The pins, in this case, would be force-fitted into holes that are provided in the plastic insulator component and receive the precut ends of the lamp lead wires.

We claim as our invention:

1. In an electric lamp or similar device that has an envelope with an end portion which includes a protruding lead-in conductor and is secured to a base structure, the improvement comprising the combination of;

an insulator component of plastic resin material that constitutes an end wall portion of the base structure and has an aperture therein, said lead-in conductor being of such length and being so arranged that the end thereof extends into the aperture in the plastic insulator component, and a rigid metal pin of predetermined length having an end segment in force-fitted frictional engagement with the apertured portion of said plastic insulator component and mechanically locked thereby in positive electrical contact with the end of the lead-in conductor that is disposed in said aperture, the end of said conductor being tightly clamped between the force-fitted portions of the metal pin and plastic insulator component, and the free end segment of said metal pin extending outwardly from the base structure and plastic insulator component a distance such that the pin constitutes an elongated exposed terminal of controlled size and configuration for the electric lamp or similar device.

2. The improvement of claim 1 wherein the force-fitted end segment of the metal terminal-pin has a rough surface with protrusions that penetrate and firmly grip the plastic insulator component.

3. The improvement of claim 2 wherein said terminal-pin is composed of solid metal.

4. In an electric discharge lamp of the low-pressure type having a vitreous tubular envelope with an end portion that has a pair of protruding lead-in wires and is secured to a base structure, the improvement comprising the combination of;

an insulator component of plastic resin material that constitutes an end wall portion of the base structure and has a pair of spaced apertures therein, said pair of lead-in wires being of such length and being so arranged that the ends thereof are substantially straight and extend into the respective apertures in the plastic insulator component, and a pair of rigid metal pins of predetermined length having end segments in force-fitted frictional engagement with the apertured portions of said plastic insulator component and mechanically locked thereby in positive electrical contact with the substantially straight ends of the lead-in wires disposed in the respective apertures, the substantially straight ends of the lead-in wires being tightly clamped between the force-fitted portions of the metal pins and plastic insulator component, and the free end segments of said pins extending outwardly from the base structure and plastic insulator component distances such that the metal pins constitute a pair of spaced elongated exposed terminals of controlled size and configuration for the electric discharge lamp.

5. The improvement of claim 4 wherein;

said insulator component is composed of thermosetting plastic, and the apertured portions of the plastic insulator component have thickened wall dimensions and are thus structurally reinforced.

6. The improvement of claim 4 wherein;

said electric discharge lamp comprises a fluorescent lamp that has a tubular glass envelope which is sealed to a glass stem from which the lead-in wires extend, said base structure is of cap-like configuration and is secured in encircling relationship with the sealed end of the tubular envelope, and said terminal-pins are composed of solid metal or heat-tempered sheet metal and extend in an axial direction outwardly from the base structure.

7. The improvement of claim 6 wherein the lead-in wires extend directly from the stem into the apertures of the insulator component and are of such length that the ends thereof are substantially flush with the outer face of the insulator component.

8. The improvement of claim 6 wherein;

said plastic insulator component has a second pair of apertures that are adjacent to the apertures in which the metal pins are anchored, and each of said lead-in wires extend through one of said second pair of apertures, along the outer face of the plastic insulator component, and into the pin-anchoring apertures so that the substantially straight ends of the lead-in wires which are in clamped relationship with the metal pins are completely recessed within the confines of the base structure.

9. The improvement of claim 6 wherein the force-fitted end segments of the metal pins have rough surfaces with a plurality of protrusions that cut into and firmly grip the plastic insulator component.

10. The improvement of claim 6 wherein each of the metal pins have a laterally protruding part which is seated against the outer surface of the plastic insulator component and is so located relative to the ends of the pin that it serves as an automatic stop means, during the pin-inserting operation, that controls the length dimension of the lamp terminals formed by the exposed end portions of the inserted metal pins.

* * * * *